US005839762A

United States Patent [19]

Ho-Chou

[11] Patent Number: 5,839,762

[45] **Date of Patent: *Nov. 24, 1998**

[54] STRUCTURE OF BOOK PAGE

[76] Inventor: Lee Ho-Chou, P.O. Box 55-175, Taichung, Taiwan

[ * ] Notice: The term of this patent shall not extend beyond the expiration date of Pat. No. 5,685,569.

[21] Appl. No.: 884,404

[22] Filed: Jun. 27, 1997

[51] Int. Cl.[6] ..... B42D 1/00; B41L 43/00; B31B 1/62

[52] U.S. Cl. ..... 281/38; 281/34; 493/397

[58] Field of Search ..... 281/38, 34, 35, 281/61, 62; 283/17, 19.1, 2, 5; 493/917, 918, 396, 405, 397, 399

[56] References Cited

U.S. PATENT DOCUMENTS

| | | | |
|---|---|---|---|
| 276,961 | 5/1883 | Quillfeldt | 281/17 |
| 554,194 | 2/1896 | Newton | 281/38 |
| 4,134,322 | 1/1979 | Lillibridge | 493/917 |
| 4,530,685 | 7/1985 | Freman | 493/397 |
| 4,810,007 | 3/1989 | Nam . | |
| 5,435,600 | 7/1995 | Griffiths et al. | 283/61 |
| 5,685,569 | 11/1997 | Chou | 281/38 |

FOREIGN PATENT DOCUMENTS

| | | | |
|---|---|---|---|
| 0320130 | 8/1934 | Italy | 281/34 |

*Primary Examiner*—Andrea L. Pitts
*Assistant Examiner*—Tisa L. Stewart

[57] ABSTRACT

A structure of book page for binding a book or album comprising an elongate sheet composed of a plurality of continuous sections each including a wide rectangular portion abutting a narrow rectangular portion divided by a first and a second folding lines, a pair of flap members abutting two ends of the wide rectangular portion and divided by a pair of third folding lines, a pair of trapezoidal indentations in two ends of the narrow rectangular portion engageable with the trapezoidal flap members. Both the flap members and the narrow rectangular portion are folded upward along the second and third folding lines and attached to the upper surface of the wide rectangular portions. Where the sections are folded downward along the first folding lines. So that a continuous double-layer book pages are therefore accomplished with a trapezoidal concave in the inside margin of each of the outmost pages for receiving the trapezoidal flaps of a pair of hard covers.

8 Claims, 4 Drawing Sheets

STRUCTURE OF BOOK PAGE

BACKGROUND OF THE INVENTION

The present invention relates to book binding, more particularly to an improved structure of book page which is advantageous to the book binding and keeps the book such as an album in uniform thickness hemmed with selvages.

An autograph book, album, stamp collection book and the like always utilize thick paper or cardboard as their interior pages and bind with hard covers. To safeguard the book to be durable and elegant, the interior pages are hemmed with selvages and made a foldout strip at the inside margin (as shown in FIG. 1). The pages are bound at their foldout inside margins so as to make the inside margin of the book thicker than it's outside margin, therefore sacrificing the uniform thickness of the book.

In another instance, people employ double-layer interior pages. Each page is made of an elongate rectangular paper and folded over in the manner as to form a concave strip along the upper surface and a convex strip along the under side of it's inside margin. These book pages are gathered by nesting the convex strip of the upper pages to the concave strip of their respective lower pages. So that an uniform thickness of a book is obtained upon the binding of the book. However, other margins of the double pages are to be hemmed with selvages to protect their exposed edges from damagement of hair-side. This costs a great time and material to manufacture.

SUMMARY OF THE PRESENT INVENTION

The present invention has a main object to provide a structure of continuous book page which is a novel arrangement of double-layer papers in continuous form bound to be in uniform thickness without hemming with selvages so as to save time and material to manufacture.

Accordingly, the book page of the present invention comprises an individual of a number of continuous double-layer interior pages, each is made of a paper or cardboard in predetermined length and folded over into continuous double-layers. The paper is previously cut into a plurality of continuous roughly T-shaped configurations each of which is cut four frustums to form an interior angle of about 135 degrees with the edges of the paper therebetween. Two of the frustums are at the corners of the wide portion and other two frustums are at the median portion of the configuration so as to form a narrow section abutting a wide section, a pair of first, a second and a third folding lines are arranged along respective margins of the wide section for alternately folding the narrow section and a pair of lateral flap members on the upper surface of the wide section. This arrangement forms a plurality of continuous double-layer interior book page which has a concave strip in the inside margin of the outward surface of pair of the outmost configurations for combining with the hard covers or connecting with book pages.

Because of the folded over margins of the pages, the edges thereof will be durable without creating hair-side and the book will be in uniform thickness.

The present invention will become more fully understood by reference to the following detailed description thereof when read in conjunction with the attached drawings.

DETAILED DESCRIPTION OF THE PREFERRED EMBODIMENT

Figure 1:
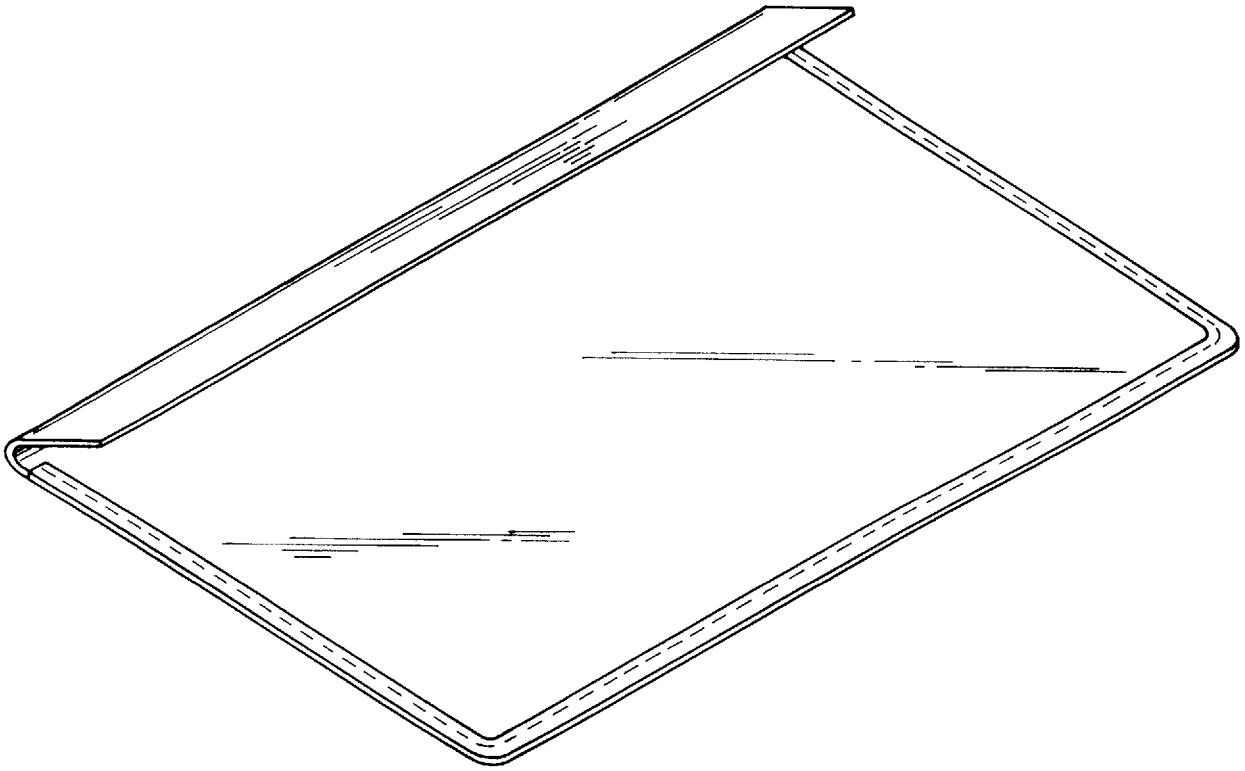
FIG. 1 PRIOR ART
FIG. 1 is a perspective view to show an interior book page of a prior art.
Figure 2:
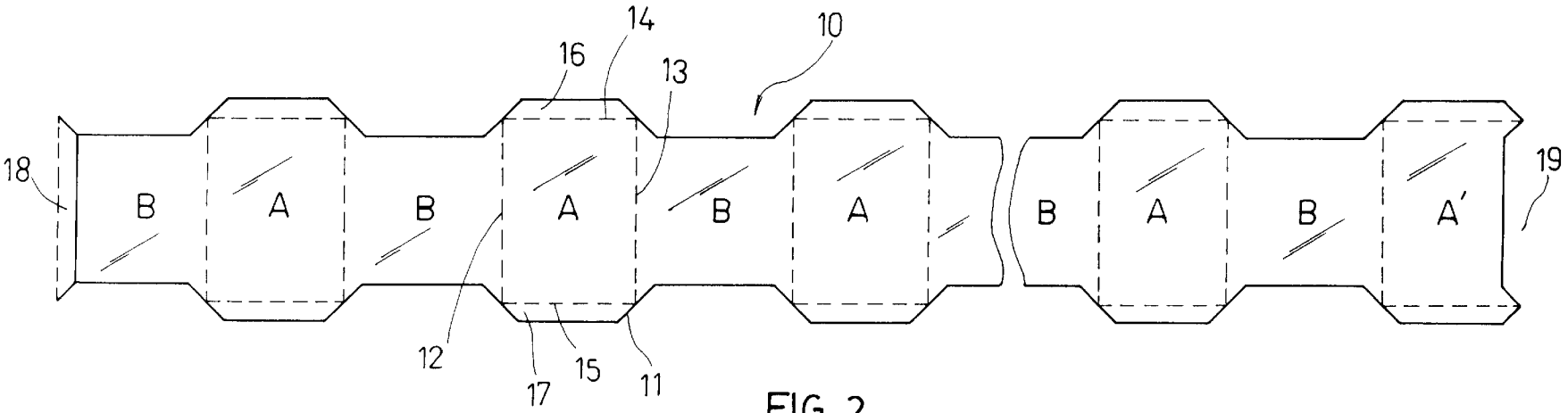
FIG. 2 is a top plane view of a preferred embodiment of the present invention.

With reference to FIG. 2 of a top plane view which illustrates a first embodiment in unfolded condition comprises an elongate rectangular paper or cardboard of predetermined length 10 which has been cut into a plurality of continuous T-shaped configurations each of which includes a wide section A and a narrow section B. The wide section A is incised at four corners so as to form four frustums 11. A pair of vertical folding lines 12 and 13 and a pair of transverse folding lines 14 and 15 parallel extend along four sides of the wide section. A perpendicular to each other with their right angled corners abutting the center of the four frustums. So that a pair of trapezoidal shaped flap members 16 and 17 are defined at two ends of the wide section A. However, a trapezoidal strip 18 (defined by broken lines) on the outward end of the narrow section B' of the first configuration is cut off and a corresponding trapezoidal indentation 19 is incised in the outward end of the wide section A' of the last configuration.

Figure 3:
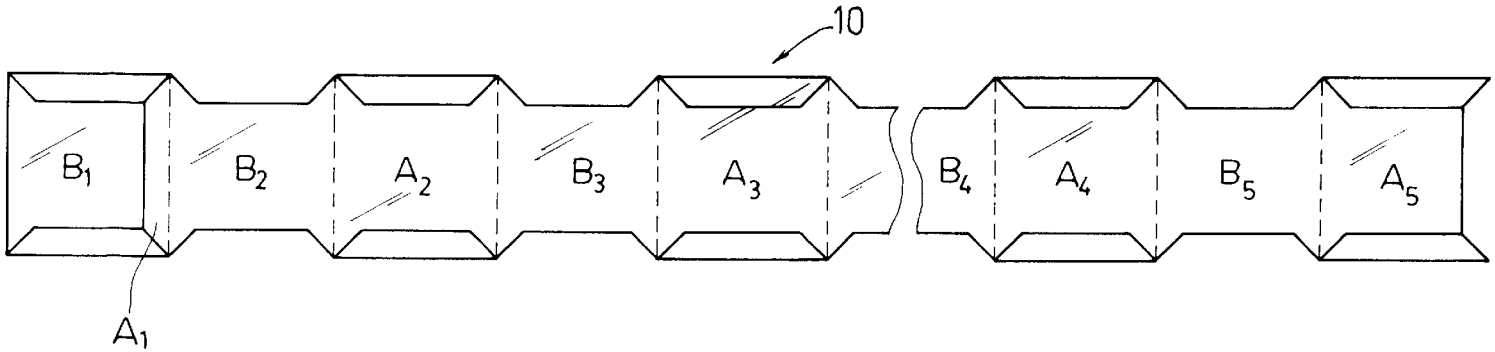
FIG. 3 is a perspective view to show a folded out book page of FIG. 2.
Figure 4:
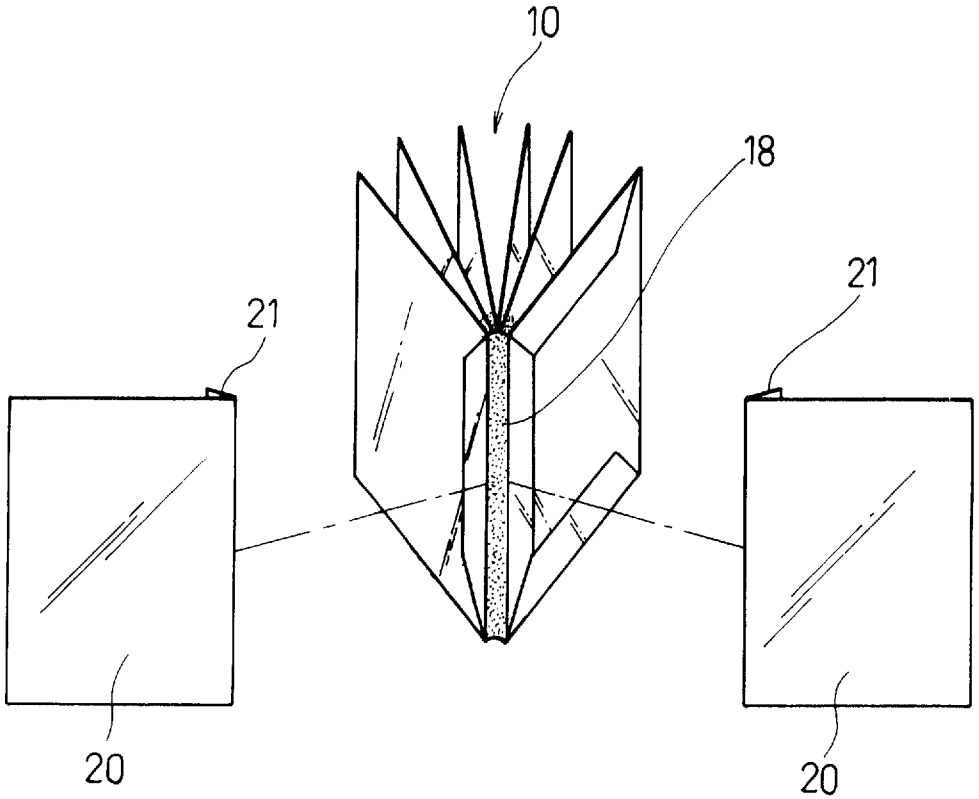
FIG. 4 is a perspective view to show a folded out book page.

Referring to FIG. 3 to achieve a continuous double-layer book page is to fold the flap members 16 and 17 attaching the upper surface of the wide sections A and fold each of the narrow sections B upward too along the folding lines 12 attaching to the upward surface of their adjacent wide sections A, and then fold each of the folded configurations downward along the folding lines 13. So that a gathering of the continuous double-layer book pages are achieved as shown in FIG. 4 in which a trapezoidal concave strips 18 and 19 is defined in the inside margin of each of the outmost pages. These trapezoidal concave strips 18 and 19 are provided to respectively nest in the trapezoidal flaps 21 of a pair of rectangular hard covers 20. Upon this arrangement, the bound book or album will be in uniform thickness and the exposed edges of the interior pages are enforced without causing hair-side, therefore saving the time and material to manufacture.

Figure 5:
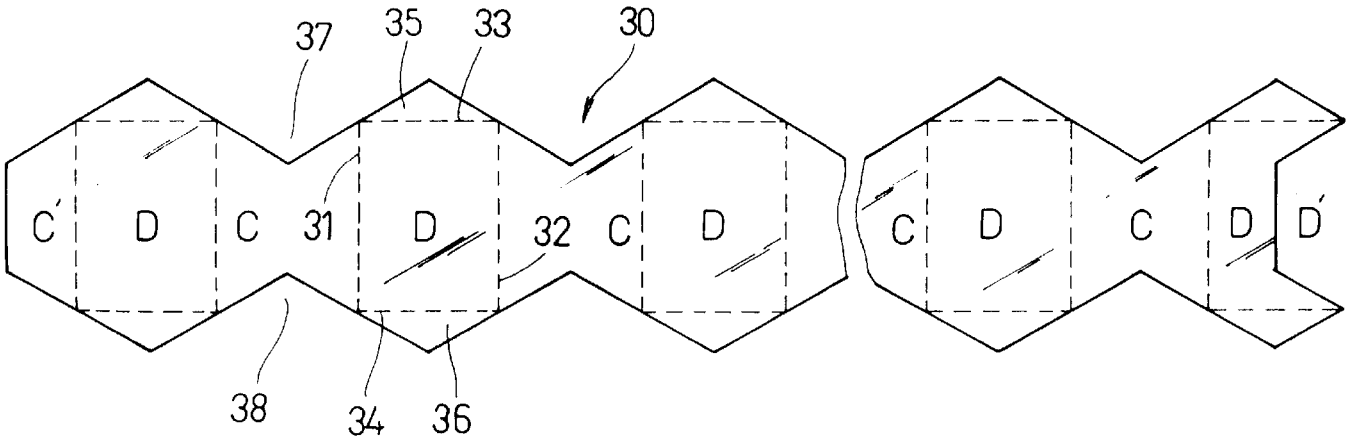
FIG. 5 is a top plane view to show an alternative embodiment of the present invention.
Figure 6:
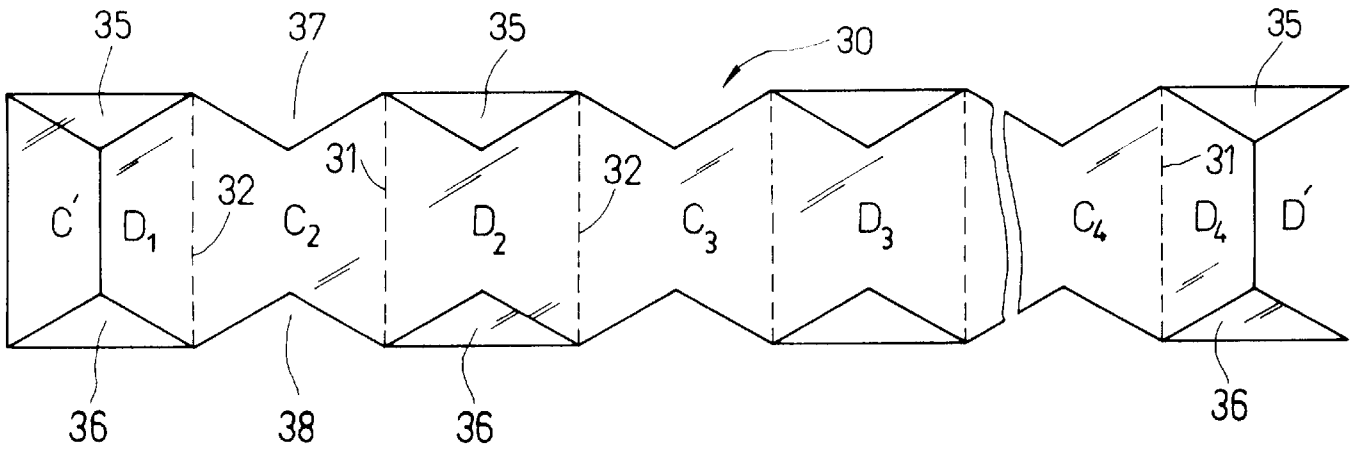
FIG. 6 is a perspective view to show a folded out book page of FIG. 5.

Referring to FIGS. 5 and 6, an alternative embodiment of the present invention is shown. In this embodiment, the general structure and function are similar to the embodiment illustrated in FIGS. 2 to 4 and the above discussion is equally applicable to this embodiment in most instance.

FIG. 5 shows an elongate paper or cardboard 30 of predetermined length which is composed of a plurality of continuously connected and partially overlaped parallelograms each has a pair of vertical folding lines 31 and 32 and a pair of transverse folding lines 33 and 34 parallel extended and perpendicular to each other to form a rectangular configuration therebetween with their right angled conjunctions abutting the center of four sides of the parallelogram. So that the elongate paper or cardboard 30 becomes a plurality of continuously connected introversively contracted sections C abutting an outward expanded section D. Each of the outward expanded section D has a pair of isosceles triangles 35 and 36 defined at two ends and engageable with a pair of corresponding triangular indentation 37 and 38 in the two ends of the introversively contracted sections C. In addition, the elongate paper 30 has a first end formed a trapezoidal portion C' which has a shape corresponding to the half of the section C, and in a second end incised a trapezoidal indentation D' which has a shape corresponding to that of the portion D'.

When folding (as shown in FIG. 6), fold all the triangles 35 and 36 and the trapezoidal portion D' upward and attach them to the upper surface of the sections D, and then fold sections C upward along the folding lines 31 and attach to the upper surface of their adjacent sections D such C1 to D1, C2 to D2 . . . C4 to D4. So that the result will be presented as shown in FIG. 3. However, the two trapezoidal concave strips in pages D1 and C4 are provided to receive the corresponding trapezoidal flaps of a pair of hard covers (not shown).

Upon such arrangement, the book pages will be also more durable without hemming selvages and the book or album is ready to thumb through.

Note that the specification relating to the above embodiments should be construed as exemplary rather than as limitative of the present invention, with many variations and modifications being readily attainable by a person of average skill in the art without departing from the spirit or scope thereof as defined by the appended claims and their legal equivalents.

I claim:

1. A structure of book page for binding a book or album comprising:

an elongate sheet composed of a plurality of continuous sections each including a wide rectangular portion and a narrow rectangular portion abutting each other and divided by a pair of vertical folding lines, a pair of flap members respectively abutting each end of the wide rectangular portion and divided by a pair of transverse folding lines, a trapezoidal indentation incised in an outward end of a last wide rectangular portion of said elongate sheet;

said pair of flaps of each wide rectangular portion and said narrow rectangular portions being folded upward and attached to an upper surface of said wide rectangular portions along the pair of transverse folding lines and one of the vertical folding lines, said each continuous section being folded downward along the other vertical folding lines so as to complete a gathering of continuous double-layer pages by which a trapezoidal concave strip is defined by the trapezoidal indentations formed in an inside margin of each of the outmost pages.

2. A book page as claimed in claim 1, wherein said book page is made from paper or cardboard.

3. A book page as claimed in claim 1, further comprising a pair of hard covers to bind said pages.

4. A book page as claimed in claim 3 wherein said hard cover each has a trapezoidal flap member engageable with the trapezoidal concave strips of said outmost pages.

5. A structure of book page for binding a book or album comprising:

an elongate sheet composed of a plurality of continuous sections divided by a plurality of first folding lines, each including a pair of corresponding first and second rectangular portions divided by a second folding line, said first rectangular portion having a pair of triangular flaps extended outward and divided by a pair of third folding lines, said second rectangular portion having a pair of triangular indentations incised in two ends thereof and engageable with the pair of triangular flaps, a trapezoidal extension extended outward from a first end of said elongate sheet, and a trapezoidal indentation incised in a second end of said elongate sheet, engageable with the trapezoidal extension;

said pair of triangular flaps of said each first rectangular portion and said second rectangular portions being folded upward along the second and third folding lines and attached to an upper surface of said adjacent first rectangular portions and said trapezoidal extension being folded upward along the second folding line and attached to an upper surface of the first rectangular portion, said sections are folded downward along the first folding lines to complete a gathering of continuous double-layer book pages with the inside margin of each of the outmost pages having a trapezoidal concave therein.

6. A book page as claimed in claim 5 wherein said sheet is made from paper or cardboard.

7. A book page as claimed in claim 5, further comprising a pair of hard covers to bind said pages.

8. A book page as claimed in claim 7, wherein said hard cover each including a trapezoidal flap member engageable with the trapezoidal concaves of said book page.

* * * * *